US008083306B2

(12) United States Patent
Görz et al.

(10) Patent No.: US 8,083,306 B2
(45) Date of Patent: Dec. 27, 2011

(54) HOUSING FOR A REFRIGERATION DEVICE

(75) Inventors: Alexander Görz, Aalen (DE); Hans Ihle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 601 days.

(21) Appl. No.: 12/085,294

(22) PCT Filed: Oct. 23, 2006

(86) PCT No.: PCT/EP2006/067666

§ 371 (c)(1),
(2), (4) Date: May 20, 2008

(87) PCT Pub. No.: WO2007/062929

PCT Pub. Date: Jun. 7, 2007

(65) Prior Publication Data

US 2009/0266102 A1 Oct. 29, 2009

(30) Foreign Application Priority Data

Nov. 30, 2005 (DE) ..... 10 2005 057 136

(51) Int. Cl.
*A47B 96/04* (2006.01)

(52) U.S. Cl. ..... 312/406; 312/401

(58) Field of Classification Search ..... 312/400, 312/401, 406, 406.1, 407; 62/265; 220/592.02
See application file for complete search history.

(56) References Cited

U.S. PATENT DOCUMENTS

| | | | | |
|---|---|---|---|---|
| 2,945,733 | A * | 7/1960 | Malia | 312/200 |
| 3,474,640 | A * | 10/1969 | Kearl et al. | 62/449 |
| 4,019,339 | A * | 4/1977 | Anderson | 62/255 |
| 4,723,418 | A * | 2/1988 | Whitmer, II | 62/298 |
| 4,895,001 | A * | 1/1990 | Jondahl | 62/326 |
| 4,966,004 | A * | 10/1990 | Midlang et al. | 62/77 |
| 5,921,095 | A | 7/1999 | Lee et al. | |

FOREIGN PATENT DOCUMENTS

| | | |
|---|---|---|
| JP | 5-164458 | 6/1993 |
| JP | 8-110148 | 4/1996 |
| WO | WO 2004/001305 | 12/2003 |

OTHER PUBLICATIONS

International Search Report PCT/EP2006/067666.

* cited by examiner

*Primary Examiner* — Hanh V Tran
(74) *Attorney, Agent, or Firm* — James E. Howard; Andre Pallapies

(57) ABSTRACT

A housing for a refrigeration device with an interior compartment that is surrounded by an insulation layer and external skin that surrounds the insulation layer. The external skin may include at least one wall which has at least two zones with different thermal conductivities.

11 Claims, 3 Drawing Sheets

HOUSING FOR A REFRIGERATION DEVICE

BACKGROUND OF THE INVENTION

The present invention relates to a housing for a refrigeration device, comprising an insulating layer which is surrounded by a strong external skin.

Conventionally, the housing of a refrigeration devices comprises an interior container and an external skin between which an insulating layer of thermally insulating foam material is arranged. In the case of free-standing refrigeration devices, the external skin is usually composed of sheet metal plates.

Free-standing refrigeration devices are known in the prior art which can be placed adjacent to one another and joined to one another (side-by-side devices). By this means, a large amount of cooling or freezing space is provided without a single device of the relevant size having to be produced and assembled. A single device of this type would have, aside from large dimensions, additionally a substantial weight, such that transportation would be made significantly more difficult.

A side-by-side arrangement is favorable also in terms of the energy consumption of the refrigeration devices, since very little heat can penetrate into the interior space by way of the mutually adjacent side walls of the devices. The mutually adjacent side walls cool down greatly during operation, so that, in places, even their external skin temperature closely approaches that in the interior of the devices. Even the external skin of adjacent walls can cool down so severely in places that airborne moisture condenses on them.

In order to prevent condensation of airborne moisture on the edge of the external skin which is connected to the edge of the interior container, it is known to lay a loop of pipe which is fed with warm, condensed coolant, or an electric heating apparatus along this edge. A corresponding solution is also conceivable for the edge regions of mutually opposing walls of two side-by-side housings, although it would be unfavorable from the standpoint of the energy consumption of the devices and would also be complex and expensive, since if it is not known in advance on which side of a refrigeration device housing a second device is to be placed, a suitable heating apparatus would have to be provided on both sides.

The high thermal conductivity of the metal external skin also favors the penetration of heat between the mutually facing walls of two side-by-side devices. The energy consumption of side-by-side devices is therefore greater than that of a combination device of comparable size and quality of insulation.

BRIEF SUMMARY OF THE INVENTION

It is an object of the present invention to provide a housing for a refrigeration device which has a particularly low energy consumption in a side-by-side arrangement.

This is thereby achieved according to the invention that in a refrigeration device housing which has an interior space surrounded by an insulating layer and an external skin surrounding the insulating layer, the external skin has at least one wall which has at least two zones with different thermal conductivities. This prevents the conduction of heat into the housing walls.

In a preferred embodiment of the invention, a central zone of at least one housing wall has a higher thermal conductivity than an edge zone. The low thermal conductivity in the edge zone reduces heat conduction into the central zone.

In another embodiment of the invention, the central zone has a lower thermal conductivity than the edge zone. By this means, heat conduction within the central zone itself is reduced.

It may also be advantageous if an intermediate zone, which is arranged between the central zone and the edge zone, has a lower thermal conductivity than the central zone and the edge zone. The intermediate zone reduces the thermal conduction from the edge zone into the central zone, even if both the edge zone and the central zone have a high thermal conductivity.

It can also be advantageous to provide a plurality of intermediate zones. The reduction of heat conduction is thereby further intensified.

In a further advantageous embodiment of the invention, the central zone is configured as a sheet metal plate. The central zone can thereby be produced economically with conventional production means.

According to a further inventive concept, the edge zone is configured as a plastics profile. Since plastics material is a very good thermal insulator and plastics profiles can be produced economically as, for example, extruded profiles, they are particularly suitable for this purpose. Furthermore, extruded plastics profiles allow other cross-sections which cannot be realized with other materials or only by very complex means.

In another alternative configuration, the central zone is made as a plastics plate. This configuration also makes economical production possible.

In another embodiment of the invention, the intermediate zone can be configured as rubber insulation. Since rubber is elastic, the central zone and the edge zones can be joined to one another by clamping.

If two housings according to the invention are placed in a side-by-side arrangement, a peripheral seal is expediently arranged between the mutually facing walls. The seal closes a gap region between the two walls in an airtight manner, thus preventing moisture-laden air from penetrating into the gap region and the moisture from condensing on the housing walls between the two refrigeration devices. In order to achieve a good insulating effect, the seal is preferably provided between two zones of the two walls having poor thermal conductivity or between the outer zones of said walls. The seal is thereby kept at a temperature close to the ambient temperature and the condensation of airborne moisture on the seal itself is prevented.

It may also be advantageous if at least one locking component is provided in the edge zone. Through the locking together of adjacent refrigeration devices, it is prevented that, for example, a gap forms between the two refrigeration devices due to incautious displacement of one refrigeration device. A gap of this type can become so large that a seal applied between the two refrigeration devices becomes ineffective.

Further features and advantages of the invention are disclosed in the following description of exemplary embodiments, making reference to the accompanying drawings, in which.

DETAILED DESCRIPTION OF THE PRESENT INVENTION

Figure 1:
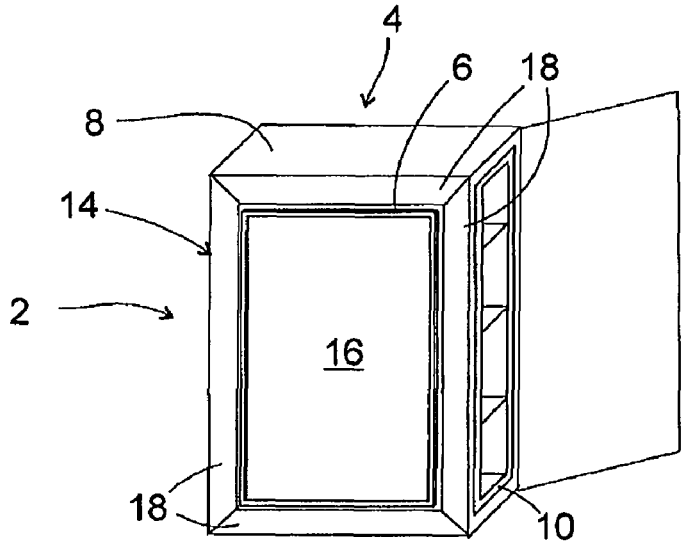
FIG. 1 shows a perspective view of a refrigeration device with a housing wall having two zones.

FIG. 1 shows a perspective view of a refrigeration device 2 with a housing 4. The housing 4 comprises a strong external skin 8 made from a plurality of parts and a deep-drawn interior container 10 made from plastics. A hollow space bordered by the external skin 8 and an interior container 10 is filled in known manner with insulating foam material. A side wall 14 of the external skin facing towards the viewer comprises a central zone which is formed by the poorly heat-conducting plastics plate 16; an edge zone surrounding the central zone is made from metallic sheets 18 which have good thermal conductivity.

A sealing band 6 made from foam material is glued along the edge of the plastics plate 16 and forms a closed frame.

Figure 2:
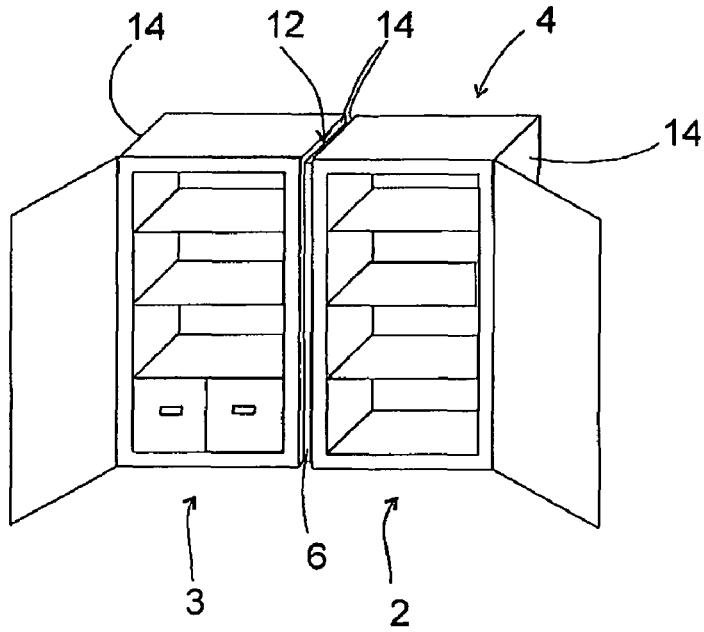
FIG. 2 shows two refrigeration devices in a side-by-side arrangement.

FIG. 2 shows a refrigeration device 2 in a side-by-side arrangement with a second refrigeration device 3. Similarly to the housing 4, the housing of the device 3 has side walls 14 which are assembled from a central plastics plate, bordered with metal sheets.

The sealing band 6 is clamped in a gap 12 between mutually facing side walls of the device 2, 3.

The poor thermal conductivity of the plastics plates 16 of the mutually facing side walls 14 prevents the flow of heat into these side walls from their edges towards the centre; the sealing band 6 prevents the transportation of heat through air circulation into the gap 12. The flow of heat into the interior of the two refrigeration devices 2, 3 via the mutually facing side walls 14 is therefore very low. At the same time, severe cooling of the metal sheets 18 which could lead to condensation of airborne moisture on them is avoided, since heat can flow only slowly from the metal sheets 18 deeper into the gap 12 and into the plates 16.

Figure 3:
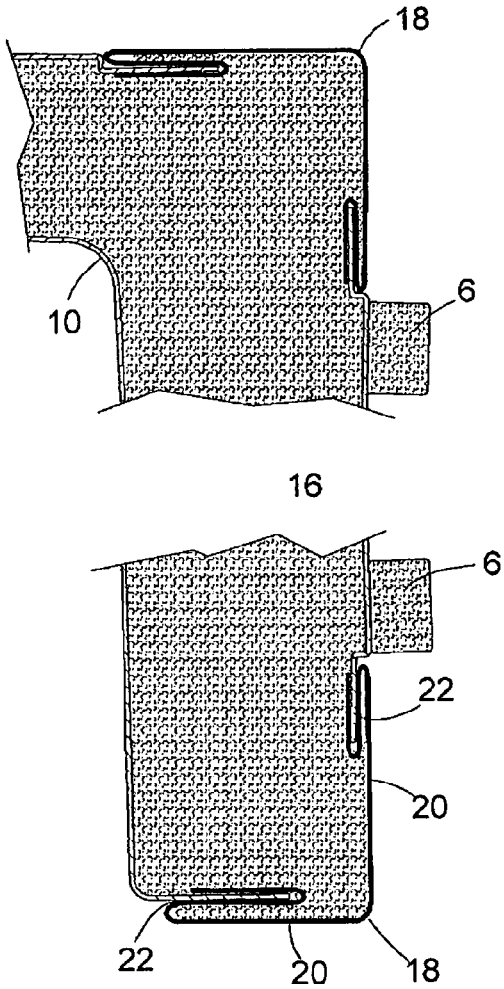
FIG. 3 shows a cross-section through a part of the housing of the refrigeration device of FIG. 1.

FIG. 3 shows a cross-section through a portion of the housing 4. The metal sheets 18 are bent into angle profiles with two limbs 20 at right angles and the limbs 20 are themselves bent over twice into a hairpin shape in order to form grooves 22 which are open at the edge in which, in each case, an edge of the plastics plate 16 or the interior container, identified as 10, is clamped.

Figure 4:
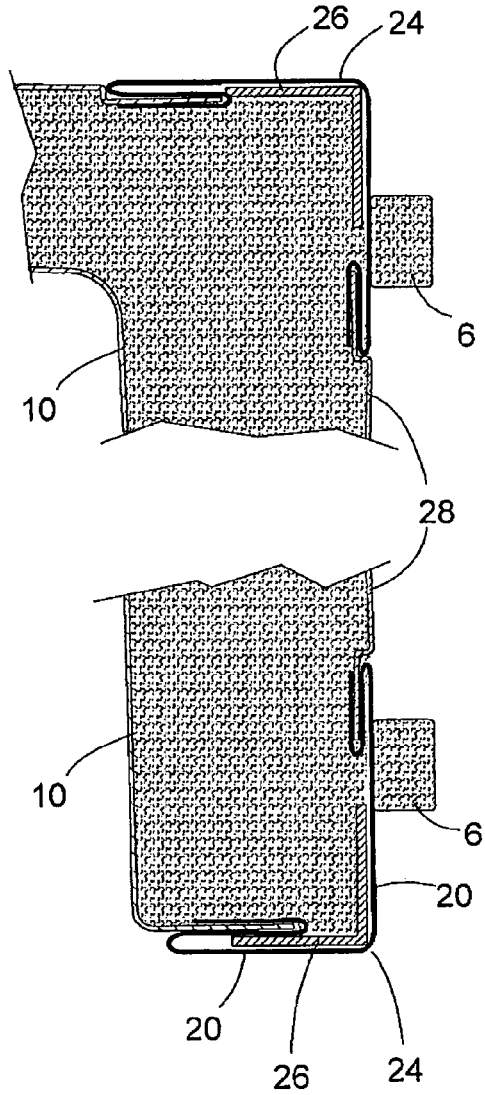
FIG. 4 shows a section similar to FIG. 3, according to an adapted embodiment.

FIG. 4 shows a section similar to FIG. 3 according to a second embodiment. The metal sheets 18 are replaced here by profiles 24 formed in similar manner from plastics. L-profiles 26 made of metal lying against the inside of the limbs 20 of these profiles 24 stiffen the structure.

The plastics plate 16 is replaced by a sheet metal plate 28 of similar configuration, so that the sheet metal plate 28 has a central zone of good thermal conductivity and the plastics profiles 24 form an edge zone of a side wall of the housing, said edge zone having poor thermal conductivity. The sealing band 6 forms a frame on the edge zone.

Here, again, the zone of poor thermal conductivity prevents the flow of heat in the side wall from the edge to the centre and the sealing band 6 prevents the transportation of heat by means of air circulating in the gap between two housings.

Figure 5:
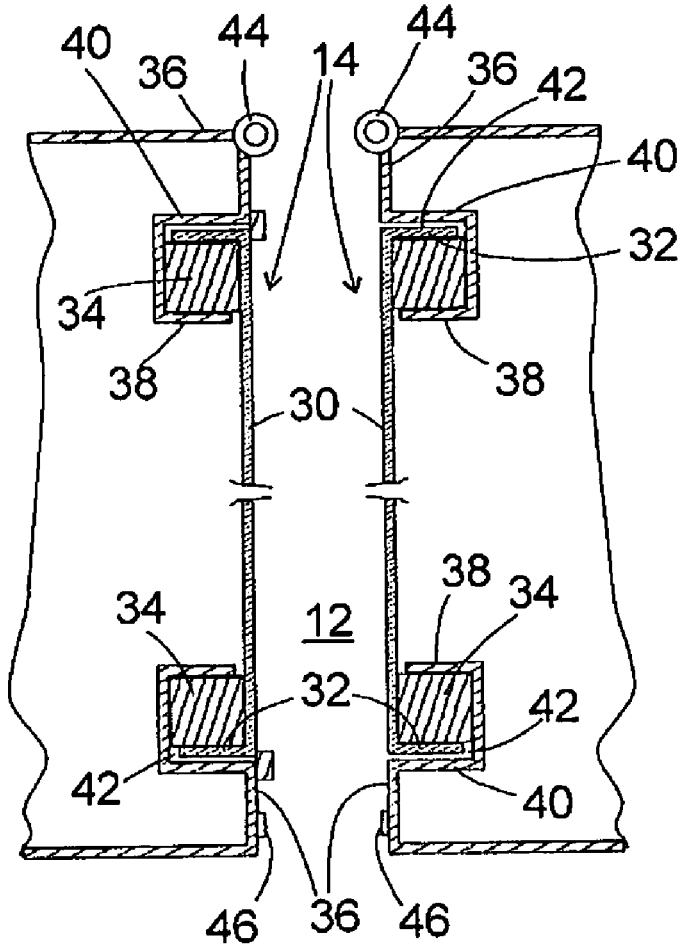
FIG. 5 shows a cross-section through part of two further housings of refrigeration devices according to the invention.

FIG. 5 shows a section through mutually facing side walls 14 of refrigeration device housings according to a third embodiment of the invention. A central zone of the walls 14 is formed by a sheet metal plate 30 and therefore has good thermal conductivity. At the four edges of the plate 30, webs 32 are angled into the interior of the housing at right angles. Extending along the inner side of these webs 32 is a peripheral flexible band 34 made, for example, from rubber, a solid foam material or another flexible compressible material of poor thermal conductivity.

An edge zone of each wall 14 is formed by four metal profiles 36 joined to form a frame. These metal profiles form a peripheral groove which receives the webs 32 and the band 34. The band 34 is clamped, in each case, between one of the webs 32 and an interior wall 38 of the groove and thereby connects the sheet metal plate, in a manner sealed by foam, to the surrounding metal profiles. An air gap 42 is kept free between the external walls 40 of the grooves and the webs 32 in each case. The plate 30 and the metal profiles do not contact one another directly at any point, so that the band 34 and the air gap 42 form an intermediate zone of poor thermal conductivity between the metal profiles 36 and the plate 30.

The air gap 42 has a sealing band 6 glued over it and covering it on one of the two housings.

Situated at a rearward corner of the walls 14 are complementary hinge members 44 which are placed engaging in one another and can be assembled into a hinge by insertion of a hinge pin, said hinge allowing the two housings to pivot relative to one another about an axis defined by the hinge. If the side walls 14 are pivoted relative to one another by this means, hoops 46 which are each mounted close to a front corner of the walls 14 are brought into a position in which they mutually overlap and can be locked together by pushing a bolt (not shown) through both hoops 46. In this position, the sealing band 6 is compressed between the two walls 14 so that heat cannot penetrate in large amounts between the two housings either by air flow into the gap 12 or by heat flow into the walls 14. Thus the metal profiles 36 remain warm without having to be heated with expenditure of energy and no airborne moisture condenses on them.

The invention claimed is:

1. A housing for a refrigeration device comprising:

an interior space, an insulating layer, and an external skin;

the interior space surrounded by the insulating layer; the external skin surrounding the insulating layer; the external skin comprising side walls of the housing defining an open front, one of said side walls having, at least two zones each having different thermal conductivities, wherein the at least two zones include a central zone having outer peripheral edges, an edge zone having inner peripheral edges, and at least one intermediate zone connecting the inner peripheral edges of the edge zone to the outer peripheral edges of the central zone; the central zone and the edge zone having a higher thermal conductivity than the at least one intermediate zone; the at least one intermediate zone being arranged between the central zone and the edge zone.

2. The housing as claimed in claim 1, wherein the central zone is constructed as a sheet metal plate.

3. The housing as claimed in claim 1, wherein the edge zone is made from thermally insulating material and surrounds the central zone in a frame-like manner.

4. The housing as claimed in claim 1, wherein the edge zone is formed as a plastics profile.

5. The housing as claimed in claim 4, wherein the plastics profile is formed in the manner of a frame.

6. The housing as claimed in claim 4, wherein the plastics profile is assembled from extruded profiles.

7. The housing as claimed in claim 1, wherein the central zone is configured as a plastics plate.

8. The housing as claimed in claim 1, wherein the intermediate zone includes a clamped flexible band.

9. The housing as claimed in claim 1, wherein at least one locking component provided in the edge zone.

10. A refrigeration apparatus comprising:

a side-by-side arrangement of two housings; each housing having an interior space, an insulating layer and an external skin; each interior space surrounded by an insulating layer; each external skin surrounding an insulating layer; each external skin comprising side walls of the housing defining an open front, one of said side walls having at least two zones each having different thermal conductivities; a seal provided between low thermal conductivity zones of mutually facing side walls of the housings, wherein the at least two zones include a central zone having outer peripheral edges, an edge zone having inner peripheral edges, and at least one intermediate zone connecting the inner peripheral edges of the edge zone to the outer peripheral edges of the central zone; the central zone and the edge zone having a higher thermal conductivity than the at least one intermediate zone; the at least one intermediate zone being arranged between the central zone and the edge zone.

11. The refrigeration apparatus as claimed in claim 10, wherein the seal is a plastic profile.

* * * * *